US005797518A

United States Patent [19]

Kieras

[11] Patent Number: 5,797,518

[45] Date of Patent: Aug. 25, 1998

[54] TWIST CAP DISPENSING FLEXIBLE TUBE

[75] Inventor: Ronald E. Kieras, Woodstock, Ill.

[73] Assignee: Courtaulds Packaging, Woodstock, Ill.

[21] Appl. No.: 768,962

[22] Filed: Dec. 18, 1996

[51] Int. Cl.[6] ..... B65D 35/00

[52] U.S. Cl. ..... 222/107; 222/509; 222/553

[58] Field of Search ..... 222/92, 106, 107, 222/214, 509, 553

[56] References Cited

U.S. PATENT DOCUMENTS

| | | | |
|---|---|---|---|
| 985,322 | 2/1911 | Beals . | |
| 1,739,303 | 12/1929 | Hawkins . | |
| 1,974,348 | 9/1934 | Strehs | 221/60 |
| 2,134,910 | 11/1938 | Divorak | 222/509 X |
| 2,619,266 | 11/1952 | McDonald | 222/548 |
| 3,255,937 | 6/1966 | Jarrett | 222/480 |
| 3,718,239 | 2/1973 | Cochran | 222/548 |
| 4,084,728 | 4/1978 | Stahl et al. | 222/153 |
| 4,141,475 | 2/1979 | Nilson | 222/494 |
| 4,308,979 | 1/1982 | Otterson | 222/516 |
| 4,739,906 | 4/1988 | LoTurco | 222/153 |
| 4,964,548 | 10/1990 | Kenyon, Jr. | 222/521 |
| 5,227,325 | 7/1993 | Yan | 222/153.14 X |

*Primary Examiner*—Gregory L. Huson
*Attorney, Agent, or Firm*—Armstrong, Westerman, Hattori, McLeland & Naughton

[57] ABSTRACT

A thermoplastic squeeze tube has a tubular member and attached rotatable closure cap, the tubular member closed by a diaphragm having a closure plug, at least one dispensing aperture, and plurality of ramps, and the closure cap having a top wall with a central dispensing orifice and plurality of closure cap ramps. On rotation of the closure cap, the closure cap ramps ride along the diaphragm ramps to force the diaphragm away from the cap top wall and open a flow path between the closure plug and top wall. Preferably a spout is provided on the closure cap so that the tube contents may be radially discharged and stop members are provided to limit rotation of the closure cap on the tubular member.

22 Claims, 3 Drawing Sheets

TWIST CAP DISPENSING FLEXIBLE TUBE

FIELD OF THE INVENTION

The present invention relates to flexible or collapsible thermoplastic tubes where pressure on the sidewall of the tube causes the tube contents to be extruded from the mouth of the tube, and more specifically where the tube has a closure which normally seals the contents of the tube from the environment but where movement of the closure, without removal from the tube, permits dispensing of the tube contents through the closure.

BACKGROUND OF THE INVENTION

Collapsible or flexible squeeze tubes of thermoplastic material are used for storage and dispensing of a myriad of everyday products such as toothpaste, shampoo, cosmetics, beauty-aids, foodstuffs and the like. Usually, such flexible tubes are sealed at one end and have a head at the other end with an opening therethrough for dispensing the contents of the tubes and a separate removable cap is provided to close the tube opening when the tube is not in use so as to protect the contents of the tube from the environment, such as oxygen in air which can oxidize and render unusable the tube contents or dry air which can cause the tube contents to dry out and become unusable. While such tube caps serve the purpose of protecting the tube contents, problems can arise because of the need to remove the cap from the tube in order to have access to the tube contents. At times, the cap may be difficult for a person with an impaired grip to grasp and remove the cap from the tube. Also, after removal of the cap, a user must find a place to set the cap and sometimes dropping or rolling of the cap to an undesirable place will cause problems. The cap may be lost or may be damaged or otherwise adversely treated so as to render it useless. In addition, after squeezing the desired amount of the tube contents from the tube, the user must replace the cap onto the tube and reseal the tube contents by use of the cap.

It is an object of the present invention to provide a squeeze tube and dispensing closure that will enable discharge of the tube contents when desired without need for removal of a closure cap from the tube.

It is another object of the present invention to provide a squeeze tube and dispensing closure that will protect the contents of the tube while permitting discharge of the contents of the tube without removal of a closure cap from the tube.

It is a further object of the present invention to provide a squeeze tube and dispensing closure which seals the contents of the tube from the environment, while enabling discharge of the contents of the tube without removal of the dispensing closure through partial rotation of the dispensing closure on the tube body in one direction and resealing of the tube merely by reverse rotation of the dispensing closure.

SUMMARY OF THE INVENTION

A squeeze tube having a dispensing closure, such that the closure need not be removed to dispense the contents of the tube, has a squeezeable or collapsible tubular member and a rotatable dispensing closure.

A tubular member has an upper end, bottom wall and a side wall extending between the upper end and the bottom wall, with an outwardly extending shoulder on the tubular member adjacent the upper end, which outwardly extending shoulder has a lower surface spaced from a support shoulder in the side wall. A flexible diaphragm extends across and closes the upper end of the tubular member, the flexible diaphragm having an upwardly extending closure plug centrally located thereon. Also on the upper surface of the diaphragm are a plurality of circumferentially spaced diaphragm ramps and at least one, and preferably a plurality of diaphragm stop members. The flexible diaphragm has at least one dispensing aperture through the diaphragm, with a plurality of spaced dispensing apertures preferred.

A dispensing closure cap is provided which has a top wall and a downwardly depending annular skirt, with an inwardly extending flange on the skirt that snaps over the outwardly extending shoulder of the tubular member to retain the closure cap on the tubular member while permitting rotation of the cap while engaged with the tubular member. The top wall of the closure member has a centrally located dispensing orifice formed through the top wall which is aligned with the closure plug on the flexible diaphragm of the tubular member when the closure cap is secured thereto. The top wall of the closure member has an underside on which there are a plurality of circumferentially spaced closure cap ramps and at least one, and preferably a plurality of closure cap stop members.

When the closure cap is initially secured to the upper end of the tubular member, the diaphragm ramps are circumferentially offset from the closure cap ramps and the closure plug on the diaphragm seals the dispensing orifice of the closure cap. By rotating the closure cap, the closure cap ramps will contact the diaphragm ramps and will force the flexible diaphragm inwardly relative to the tubular member and away from the top wall of the closure cap. The force will break the seal between the closure plug and the closure cap and form an opening so that contents of the tubular member may be squeezed from the tubular member through a dispensing aperture in the diaphragm and then outwardly through the dispensing orifice of the closure cap.

In a preferred embodiment of the squeeze tube of the present invention, a dispensing spout is provided on the closure cap such that the contents of the tube are discharged in a radial direction relative to the centrally located dispensing orifice. The spout may be in the form of a rear wall on the outer surface of the top wall of the closure cap, adjacent to one side of the dispensing orifice, a confining top wall and side walls extending across the dispensing aperture from the rear wall and a dispensing ledge extending outwardly from the top wall of the closure cap.

BRIEF DESCRIPTION OF THE DRAWINGS

The present squeeze tube will be more readily understood by reference to the following description and the accompanying drawings wherein like numerals indicate like parts throughout the drawings, and wherein.

DETAILED DESCRIPTION

Figure 1:
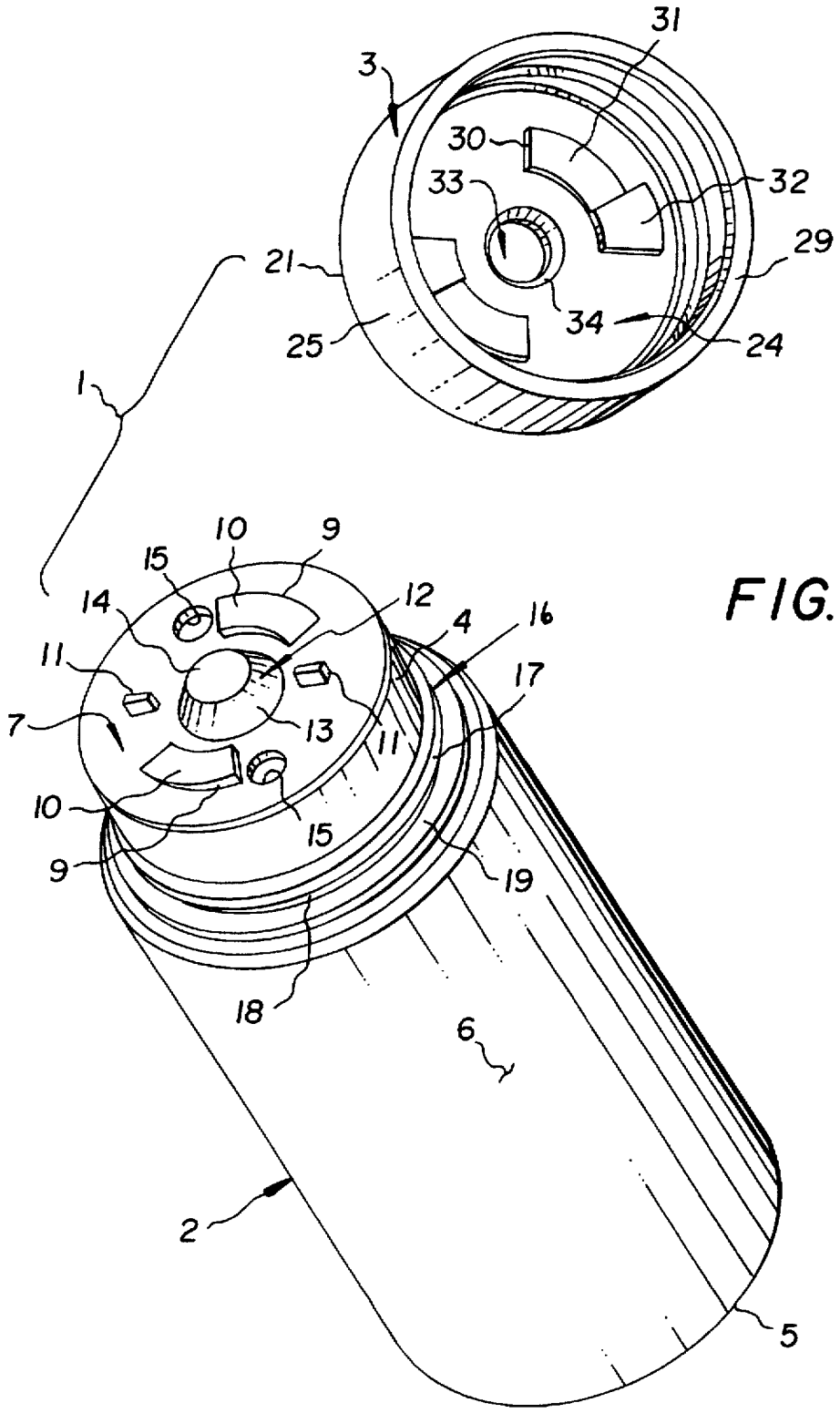
FIG. 1 is a perspective view of the tubular member of the squeeze tube and the underside of the closure cap thereof prior to securement of the closure cap on the tubular member.
Figure 2:
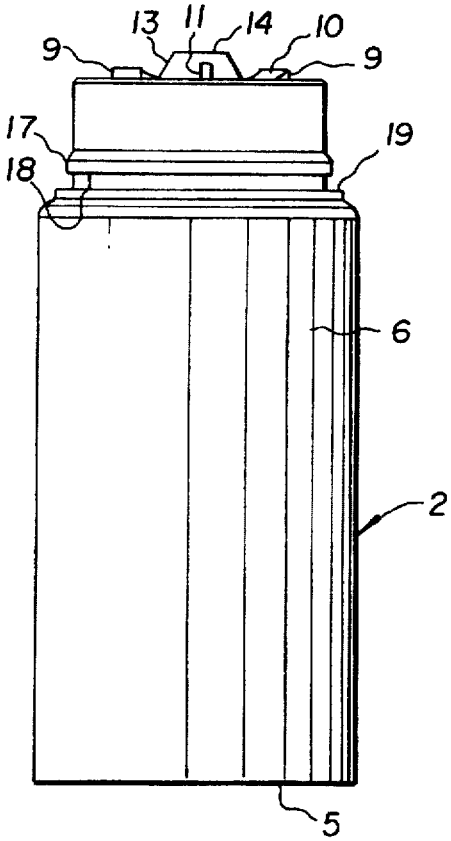
FIG. 2 is a side elevational view of the tubular member of the squeeze tube of the present invention.

Referring now to the drawings, a squeeze tube 1 having a tubular member 2 and dispensing closure 3 are shown according to one embodiment of the present invention. The squeeze tube 1 has a tubular member 2, formed from a thermoplastic material, which has an upper end or neck 4, a bottom wall 5, and a side wall 6 extending between the upper end 4 and the bottom wall 5. A flexible diaphragm 7 extends across and closes the upper end 4 of the tubular member 2. The flexible diaphragm 7 has an upper surface 8 with a plurality of circumferentially spaced diaphragm ramps 9 thereon, the spaced diaphragm ramps 9 preferably shaped to have an upper inclined surface 10. Also on the upper surface 8 of the flexible diaphragm 7 there are provided at least one, and preferably a plurality, of spaced diaphragm stop members 11, in the form of upwardly extending projections, and a centrally located upwardly extending closure plug 12. The closure plug 12 is preferably in the form of a truncated cone having an inclined wall 13 and top wall 14. At least one dispensing aperture 15, and preferably a plurality of such dispensing apertures, is formed through the flexible diaphragm 7. A closure engaging means 16 is provided on the side wall 6 of tubular member 3 adjacent the upper end 4, and is shown as an outwardly extending shoulder 17 having a lower surface 18, which is spaced from a support shoulder 19 provided in the side wall 6 of the tubular member 2.

The dispensing closure 3 comprises a dispensing closure cap 21 that has a top wall 22 with an upper surface 23 and an underside 24, and a downwardly depending annular skirt 25 on said top wall 22. The downwardly depending annular skirt 25 has a tubular member engaging means 26 thereon, such as an inwardly extending flange 27 having an upper surface 28 and a bottom support face 29. On the underside 24 of the top wall 22 of the dispensing closure cap 21 there are provided a plurality of circumferentially spaced closure cap ramps 30, shaped to have a lower inclined surface 31, and at least one, and preferably a plurality, of closure cap stop members 32 in the form of downwardly extending projections. A centrally located dispensing orifice 33 is formed in the top wall 22 of the dispensing closure cap 21, and the top wall preferably has a bevelled portion 34 about the dispensing orifice 33 which is adapted to seat flush against the inclined wall 13 of the closure plug 12 when the closure cap 21 is secured on the tubular member 2 to seal the contents of the tubular member 2. A preferred embodiment of the dispensing closure cap 21 may have a dispensing spout 35 having a passageway 36 communicating with the dispensing orifice 33 to dispense tubular member contents from the tubular member 2 in a radial direction. The spout, as illustrated, may comprise a rear wall 37 adjacent one side of the dispensing orifice 33, a spaced confining top wall 38 and confining side walls 39 extending from the rear wall 37 across the dispensing orifice 33 and outwardly from the top wall 22, with a dispensing ledge 40 provided extending outwardly from the top wall 22.

Figure 5:
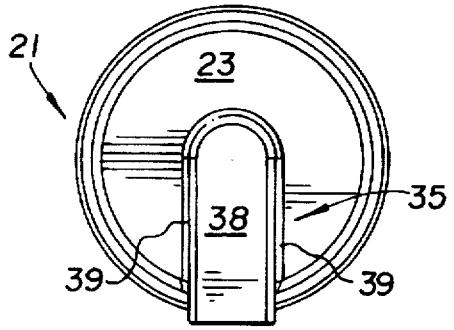
FIG. 5 is a top plan view of the closure cap illustrated in FIG. 3.
Figure 6:
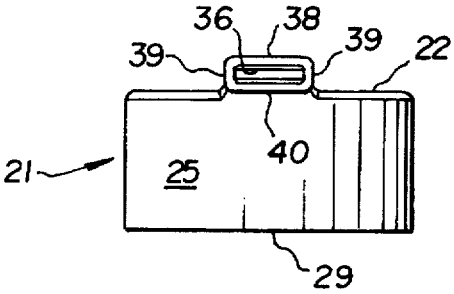
FIG. 6 is a front view of the closure cap illustrated in FIG. 3 looking towards the passageway of the spout.
Figure 3:
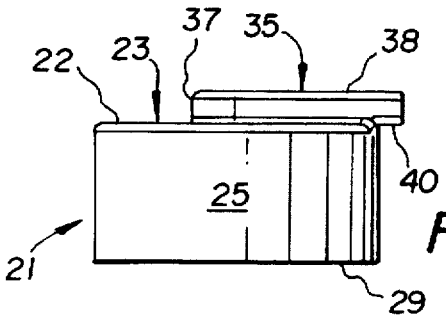
FIG. 3 is a side elevational view of the closure cap of the squeeze tube of the present invention having a dispensing spout thereon.
Figure 7:
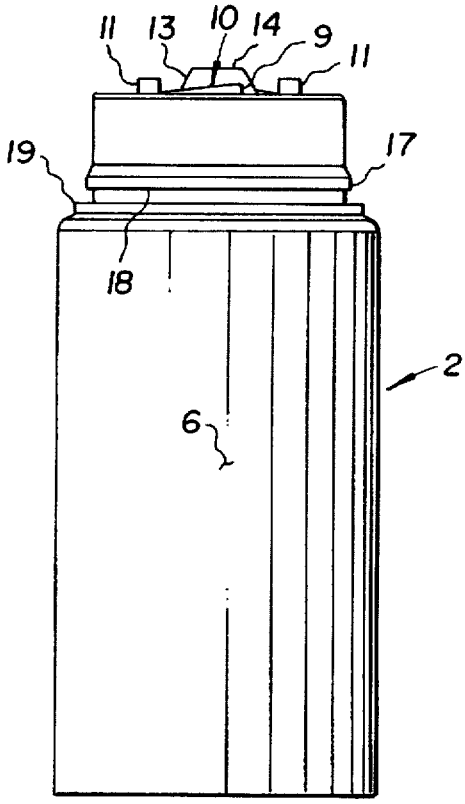
FIG. 7 is a view of the tubular member illustrated in FIG. 2 rotated 90°.
Figure 4:
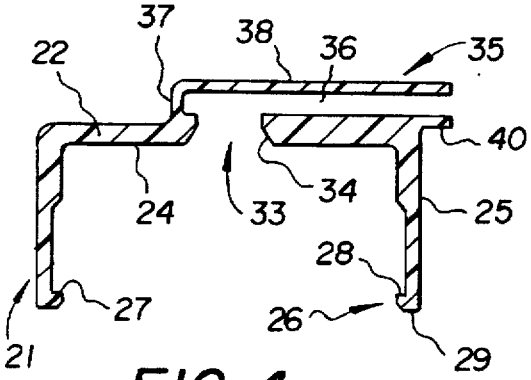
FIG. 4 is a vertical cross-sectional view taken through the closure cap of FIG. 3 with the closure cap ramps not shown.

In order to provide a stand-up capability for the tube when resting on the closure cap 21, the closure cap 21 preferably has an upwardly extending support wall 41 about a portion of the periphery of the upper surface 23 of the top wall 22 so that the tube may be rested on the support wall 41 on a support surface. The support wall most preferably has an upper planar surface 42, which is coplanar with the top wall 38 of the dispensing spout 35, such that the tube may be placed on a support surface with support for the tube provided by both support wall 41 and the top wall 38 of the dispensing spout 35. The support wall 41, as illustrated in FIG. 5, may extend about 270° about the periphery of the closure cap 21 with the dispensing spout extending from the open area of the support wall.

Figure 8:
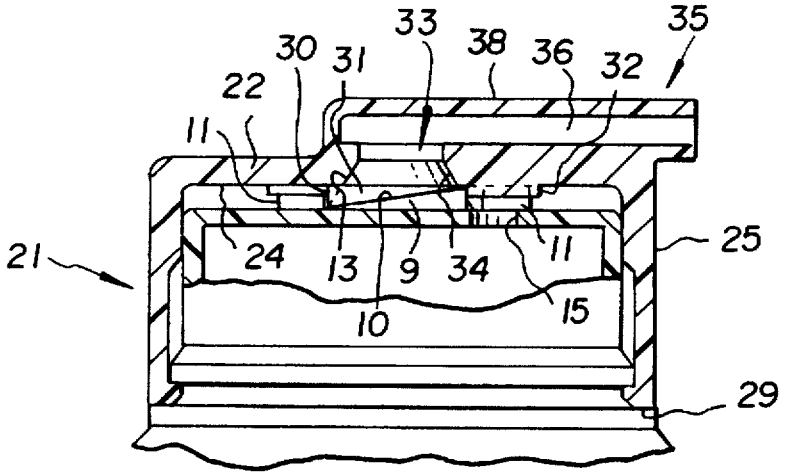
FIG. 8 is a vertical cross-sectional view through the upper portion of a tubular member and attached closure cap shown in rest or sealed condition.

The circumferentially spaced diaphragm ramps 9 on the tubular member 2 and the circumferentially spaced closure cap ramps 30 on the closure cap 3 are arranged such that, when in rest position, the diaphragm ramps 9 are circumferentially preferably offset from the closure cap ramps 30. The upper inclined surface 10 of each of the diaphragm ramps 9 are preferably complementary with the lower inclined surface 31 of adjacent closure cap ramps 30 at this position. Also, in this rest position, as shown in FIG. 8, with the closure cap 21 secured to the tubular member 2, the closure plug 12 is sealingly engaged with the closure cap top wall 22 by contact with the bevelled portion 34 about the dispensing surface 33. The squeeze tube contents are thus retained in the tubular member 3 and protected from the environment.

Figure 9:
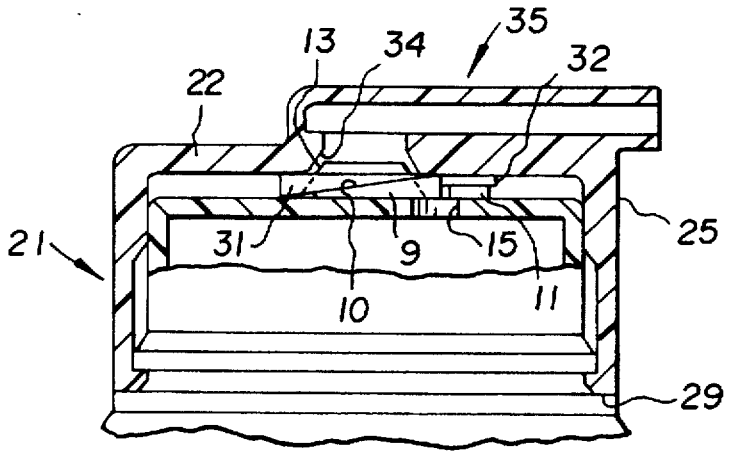
FIG. 9 is a vertical cross-sectional view through the upper portion of a tubular member and attached closure cap showing the closure cap rotated to dispensing position.

When a user desires to discharge contents of the tubular member, the closure cap 21 is rotated from rest position to a discharge position as shown in FIG. 9. By rotation of the closure cap 21, with the closure engaging means on the tubular member 2 preventing upward axial movement of the dispensing closure cap 21, the closure cap ramps 30 contact and ride along the adjacent diaphragm ramps 9, forcing the diaphragm 7 inwardly towards the interior of the tubular member 2 and breaking the seal between the closure plug 12 on the diaphragm 7 and the bevelled portion 34 about the dispensing orifice 33 of the closure cap 21. By squeezing the tubular member 2, the user forces contents of the tube through dispensing aperture 15 and then through a clearance provided between the closure plug 12 and the bevelled portion 34 of dispensing orifice 33 for use. Where a dispensing spout 35 is provided, the contents of the tubular member 2, after flowing through the clearance between the closure plug 12 and the bevelled portion 34 of the dispensing orifice 33, will flow through the passageway 36 communicating with the dispensing orifice 33, as shown by the arrow in FIG. 9, and radially outwardly from the squeeze tube through the spout and over dispensing ledge 40. To reseal the tubular member contents from the environment after use, the user merely reverses the rotation of the closure cap 21 so that the closure cap ramps 30 are removed from forcing contact with the diaphragm ramps 9 and the flexible diaphragm 7 will return to rest portion with the closure plug 12 sealing the dispensing orifice 33. diaphragm stop members 11 and closure cap stop members 32 are arranged so as to limit the degree of rotation of the closure cap on the tubular member 2 to a maximum of about 90° and prevent the closure cap ramps 30 from overriding the diaphragm ramps 9.

The tubular member 2 and dispensing closure 3 are formed from a thermoplastic material such as polyethylene or polypropylene or copolymers thereof.

What is claimed is:

1. A thermoplastic squeeze tube having a dispensing closure comprising:

a tubular member having an upper end, a bottom wall, a side wall extending between said upper end and said bottom wall, and a closure engaging means on said side wall adjacent said upper end;

a flexible diaphragm extending across and closing the upper end of said tubular member, said flexible diaphragm having an upper surface with a plurality of circumferentially spaced diaphragm ramps, a centrally located upwardly extending closure plug thereon, and at least one dispensing aperture therethrough;

a dispensing closure cap having a top wall and a downwardly depending annular skirt, said skirt having a tubular member engaging means thereon engageable with said closure engaging means on said tubular member to retain said closure cap on said tubular member while permitting rotation of said closure cap thereon;

said top wall having an underside having thereon a plurality of closure cap ramps, and a centrally located dispensing orifice formed therethrough;

whereby when said dispensing closure cap is secured to the upper end of said tubular member with said closure plug sealing said dispensing orifice, rotation of said closure cap will cause said closure cap ramps to contact said diaphragm ramps to force said diaphragm inwardly relative said tubular member and away from said top wall and form an opening for passage of contents of said tubular member through said at least one dispensing aperture of said diaphragm and outwardly through said dispensing orifice of said closure cap.

2. The thermoplastic squeeze tube as defined in claim 1 wherein a dispensing spout is provided on the top wall of said closure cap, said closure spout having a passageway communicating with the dispensing orifice in said top wall so as to dispense tubular member contents from said tubular member in a radial direction.

3. The thermoplastic squeeze tube as defined in claim 2 wherein said closure spout has a rear wall adjacent one side of the dispensing orifice, a spaced confining top wall and confining side walls extending from said rear wall across said dispensing orifice and outwardly from said top wall, and a dispensing ledge extending outwardly from said top wall.

4. The thermoplastic squeeze tube as defined in claim 1 wherein the flexible diaphragm of said tubular member has at least one diaphragm stop member on said upper surface thereof.

5. The thermoplastic squeeze tube as defined in claim 4 wherein the flexible diaphragm has a plurality of diaphragm stop members thereon.

6. The thermoplastic squeeze tube as defined in claim 1 wherein the underside of the top wall of said dispensing closure cap has at least one closure cap stop member thereon.

7. The thermoplastic squeeze tube as defined in claim 1 wherein the underside of the top wall of said dispensing closure cap has a plurality of closure cap stop members thereon.

8. The thermoplastic squeeze tube as defined in claim 7 wherein each of said plurality of diaphragm ramps have an upper inclined surface.

9. The thermoplastic squeeze tube as defined in claim 8 wherein each of said plurality of closure cap ramps have a lower inclined surface complementary with the upper inclined surface of an adjacent diaphragm ramp.

10. The thermoplastic squeeze tube as defined in claim 1 wherein said closure engaging means on said tubular member is an outwardly extending shoulder and said tubular member engaging means on the skirt of said closure cap is an inwardly extending flange.

11. The thermoplastic squeeze tube as defined in claim 1 wherein said tubular member and said dispensing closure cap are composed of a thermoplastic material selected from the group consisting essentially of polyethylene, polypropylene and copolymers thereof.

12. The thermoplastic squeeze tube as defined in claim 1 wherein the top wall of said closure cap has an upwardly extending support wall about a portion of the periphery thereof.

13. The thermoplastic squeeze tube as defined in claim 12 wherein a dispensing spout is provided on the top wall of said closure cap, said closure spout having a passageway communicating with the dispensing orifice in said top wall so as to dispense tubular member contents from said tubular member in a radial direction, and said upwardly extending support wall has an upper planar surface coplanar with a top wall of said closure spout.

14. A thermoplastic squeeze tube having a dispensing closure comprising:

a tubular member having an upper end, a bottom wall, a side wall extending between said upper end and said bottom wall, and a closure engaging means on said side wall adjacent said upper end;

a flexible diaphragm extending across and closing the upper end of said tubular member, said flexible diaphragm having an upper surface with a plurality of spaced diaphragm ramps, each of which has an upper inclined surface, a centrally located upwardly extending closure plug thereon, and a plurality of dispensing apertures therethrough;

a dispensing closure cap having a top wall and a downwardly depending annular skirt, said skirt having a tubular member engaging means thereon engageable with said closure engaging means on said tubular member to retain said closure cap on said tubular member while permitting rotation of said closure cap thereon;

said top wall having an underside having thereon a plurality of closure cap ramps each of which has a lower inclined surface complementary with an upper inclined surface of an adjacent diaphragm ramp, and a centrally located dispensing orifice formed therethrough;

and a dispensing spout on the top wall of said closure cap, said closure spout having a passageway communicating with the dispensing orifice in said top wall so as to dispense tubular member contents from said tubular member in a radial direction;

whereby when said dispensing closure cap is secured to the upper end of said tubular member with said closure plug sealing said dispensing orifice, rotation of said closure cap will cause said closure cap ramps to contact said diaphragm ramps to force said diaphragm inwardly relative said tubular member and away from said top wall and form an opening for contents of said tubular member through said plurality of dispensing apertures of said diaphragm and outwardly through said dispensing orifice and dispensing spout of said closure cap.

15. The thermoplastic squeeze tube as defined in claim 14 wherein said closure spout has a rear wall adjacent one side of the dispensing orifice, a spaced confining top wall and confining side walls extending from said rear wall across said dispensing orifice and outwardly from said top wall, and a dispensing ledge extending outwardly from said top wall.

16. The thermoplastic squeeze tube as defined in claim 14 wherein the flexible diaphragm of said tubular member has at least one diaphragm stop member on said upper surface thereof.

17. The thermoplastic squeeze tube as defined in claim 14 wherein the flexible diaphragm has a plurality of diaphragm stop members thereon.

18. The thermoplastic squeeze tube as defined in claim 14 wherein the underside of the top wall of said dispensing closure cap has at least one closure cap stop member thereon.

19. The thermoplastic squeeze tube as defined in claim 14 wherein the underside of the top wall of said dispensing closure cap has a plurality of closure cap stop members thereon.

20. The thermoplastic squeeze tube as defined in claim 14 wherein said tubular member and said dispensing closure cap are composed of a thermoplastic material selected from the group consisting essentially of polyethylene, polypropylene and copolymers thereof.

21. The thermoplastic squeeze tube as defined in claim 14 wherein the top wall of said closure cap has an upwardly extending support wall about a portion of the periphery thereof.

22. The thermoplastic squeeze tube as defined in claim 21 wherein said closure spout has a top wall and said upwardly extending support wall has an upper planar surface coplanar with said top wall of said closure spout.

* * * * *